US005819646A

United States Patent [19]

Fukunaga

[11] Patent Number: 5,819,646

[45] Date of Patent: Oct. 13, 1998

[54] PRESSING ROLL FOR A FIXING DEVICE

[75] Inventor: Noritomo Fukunaga, Tokyo, Japan

[73] Assignee: Kinyosha Co., Ltd., Tokyo, Japan

[21] Appl. No.: 641,360

[22] Filed: Apr. 30, 1996

[51] Int. Cl.[6] ..... B30B 3/04

[52] U.S. Cl. ..... 100/176; 492/53; 492/56

[58] Field of Search ..... 100/93 RP, 155 R, 100/176; 492/53, 56

[56] References Cited

U.S. PATENT DOCUMENTS

| | | | |
|---|---|---|---|
| 2,263,285 | 11/1941 | Bolog | 492/53 |
| 2,374,194 | 4/1945 | Grupe | 100/155 R |
| 2,685,548 | 8/1954 | Drozdowski | 100/176 |
| 3,467,009 | 9/1969 | Ross | 492/56 |
| 4,178,200 | 12/1979 | Hakert et al. | 492/56 |
| 4,378,622 | 4/1983 | Pinkston et al. | 492/56 |
| 4,823,689 | 4/1989 | Kishino et al. | 100/176 |
| 5,195,228 | 3/1993 | Fukunaga et al. | 492/53 |
| 5,403,995 | 4/1995 | Kishino et al. | 492/56 |
| 5,468,531 | 11/1995 | Kikukawa et al. | 492/56 |
| 5,520,600 | 5/1996 | Fukumoto | 492/56 |
| 5,561,511 | 10/1996 | Mizunuma et al. | 492/53 |

FOREIGN PATENT DOCUMENTS

| | | | |
|---|---|---|---|
| 60-68927 | 4/1985 | Japan | 492/56 |
| 12517 | 4/1914 | United Kingdom | 492/53 |

*Primary Examiner*—Stephen F. Gerrity
*Attorney, Agent, or Firm*—Oblon, Spivak, McClelland, Maier & Neustadt, P.C.

[57] ABSTRACT

A fixing device comprises a thermal fixing roll and a pressing roll forming a nip portion together with the thermal fixing roll. The pressing roll included in the fixing device comprises a core, a sponge rubber layer covering the outer circumferential surface of the core and provided with a large number of through-holes extending in parallel with the axis of the core and arranged equidistantly from the outer circumferential surface of the core, a rubbery elastic layer formed in a thickness of 350 to 4500 $\mu$m to cover the outer circumferential surface of the sponge layer, and a fluorocarbon resin layer formed to cover the outer circumferential surface of the rubbery elastic layer.

6 Claims, 2 Drawing Sheets

PRESSING ROLL FOR A FIXING DEVICE

BACKGROUND OF THE INVENTION

1. Field of the Invention

The present invention relates to a fixing device, particularly, to a pressing roll for a fixing device used in electrophotographic copying machines such as copiers, facsimile devices and printers.

2. Description of the Related Art

FIG. 1 shows a conventional fixing device 1. As seen from the drawing, the fixing device 1 comprises a thermal fixing roll 3 provided with a heat source 2 and a pressing roll 6 prepared by forming an elastic body 5 to cover the outer circumferential surface of a core 4. The pressing roll 6 is disposed to form a nip portion between the thermal fixing roll 3 and the pressing roll 6. Unfixed toner 8 transferred onto a substrate 7 such as a paper sheet passes through the nip portion. In passing through the nip portion, the unfixed toner 8 is fixed by the heat and pressure to form a fixed toner 9 on the substrate 7.

In recent years, copiers are required to be lighter in weight, smaller in size and lower in power consumption. To meet these requirements, an improved pressure roller as shown in FIG. 2 was proposed in, for example, U.S. Pat. No. 5,195,228. It is seen that a sponge layer 12 provided with a large number of through-holes 11 is formed to cover the outer circumferential surface of a core 13, with an adhesive layer 14 interposed therebetween. Further, a fluorocarbon resin layer 15 having a thickness of 50 to 110 $\mu$m is formed to cover the outer circumferential surface of the sponge layer 12, with another adhesive layer 16 interposed therebetween.

The through-holes 11 formed in the sponge layer 12 are intended to prevent the pressing roll from being deformed by the heat of high temperatures generated during use of the copier or the like. To be more specific, if the through-holes 11 are not formed in the sponge layer 12, the gas within the sponge layer 12, which is thermally expanded during operation of a copier, is not released to the outside. As a result, the pressing roll is much deformed, giving rise to curling and wrinkles on the copying material such as a paper sheet. Where the through-holes 11 are formed in the sponge layer 12 as in the pressing roll shown in FIG. 2, however, the thermally expanded gas is released to the outside of the roll so as to ensure a uniform roll contour. Further, the fluorocarbon resin layer 15 formed to cover the outer circumferential surface of the sponge layer 12 is intended to prevent a toner adhesion to the roll because the fluorocarbon resin exhibits good mold release characteristics, thereby to improve the durability of the roll surface. Still further, the pressing roll of a two-layer structure as shown in FIG. 2 has a large nipping width, is lower in load and permits miniaturization and, thus, is widely used nowadays.

Additional improvements of a pressing roll have also been proposed to date. For example, Japanese Patent Disclosure (Kokai) No. 3-266873 proposes that it is advantageous to use a conductive silicone rubber sponge layer in place of the sponge layer 12 used in the pressing roll shown in FIG. 2. Further, Japanese Patent Disclosure (Kokai) No. 4-340579 proposes that it is advantageous to use a fluorocarbon resin layer imparted with an electrical conductivity in place of the fluorocarbon resin layer 15 used in the pressing roll shown in FIG. 2.

However, the pressing roll shown in FIG. 2 leaves much room for further improvements. Specifically, FIG. 3 schematically shows in a magnified fashion the pressing roll shown in FIG. 2. It is seen that the sponge layer 12 contains a large number of cells 17 and is bonded to the fluorocarbon resin layer 15, with the adhesive layer 16 having a thickness $D_1$ interposed therebetween. What should be noted, however, is that non-contact portions 18 where the sponge layer 12 is not in contact with the fluorocarbon resin layer 15 are generated in many cases. Upon receipt of a load, the pressing roll is deformed as shown in FIG. 4 so as to enlarge the non-contact portion 18, with the result that peeling is generated between the sponge layer 12 and the fluorocarbon resin layer 15.

Some measures to suppress the peeling phenomenon have been proposed in an attempt to improve the durability of the pressing roll. However, where the thickness $D_1$ of the adhesive layer 16 is 3 to 150 $\mu$m, the maximum number of copying sheets processed by the pressing roll under the required conditions is only about 150,000 to 200,000. Further, some additional improvements have also been proposed. For example, it has been proposed to increase the thickness of the fluorocarbon resin layer. However, a satisfactory result has not yet been obtained. It has also been proposed to control as desired the foaming degree of the sponge layer so as to form a sponge layer of a desired hardness. However, a satisfactory result has not yet been obtained. Further, it has also been proposed to improve the material of the adhesive layer 16 formed between the fluorocarbon resin layer 15 and the sponge layer 12, though a satisfactory result has not yet been reported.

SUMMARY OF THE INVENTION

An object of the present invention is to provide a fixing device which exhibits an excellent durability even if used under severe conditions such as a high rotation speed, a high load and a large nipping width.

According to a first aspect of the present invention, there is provided a fixing device comprising a thermal fixing roll and a pressing roll forming a nip portion together with the thermal fixing roll, characterized in that the pressing roll comprises a core, a sponge layer covering the outer circumferential surface of the core and provided with a large number of through-holes extending in parallel with the axis of the core, a rubbery elastic layer formed in a thickness of 350 to 4500 $\mu$m to cover the outer circumferential surface of the sponge layer, and a fluorocarbon layer formed to cover the outer circumferential surface of the rubbery elastic layer.

According to a second aspect of the present invention, there is provided a fixing device comprising a thermal fixing roll and a pressing roll forming a nip portion together with the thermal fixing roll, characterized in that the pressing roll comprises a core, a sponge layer covering the outer circumferential surface of the core and provided with a large number of spiral through-holes spirally extending along the core, a rubbery elastic layer formed in a thickness of 350 to 4500 $\mu$m to cover the outer circumferential surface of the sponge layer, and a fluorocarbon layer formed to cover the outer circumferential surface of the rubbery elastic layer.

In the present invention, it is desirable for the rubbery elastic layer of the pressing roll to have a hardness higher than that of the sponge layer. It is also desirable for the fluorocarbon resin layer of the pressing roll to have a thickness of 30 to 500 $\mu$m.

DETAILED DESCRIPTION OF THE PREFERRED EMBODIMENTS

Figure 1:
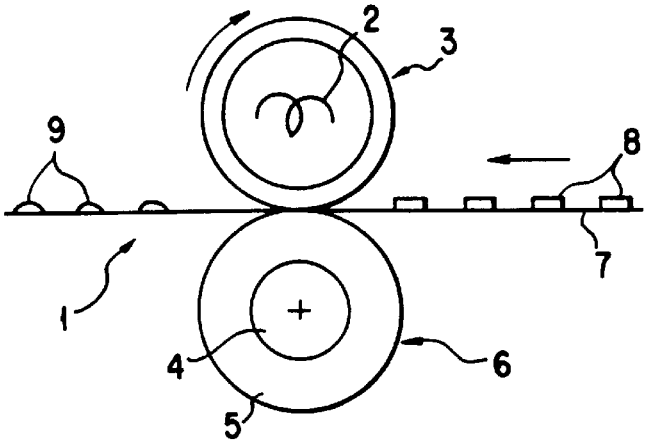
FIG. 1 PRIOR ART
FIG. 1 schematically shows a conventional fixing device.
Figure 2:
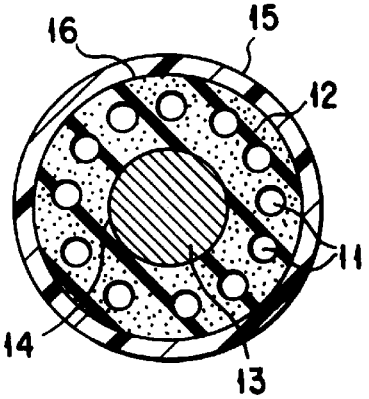
FIG. 2 PRIOR ART
FIG. 2 is a cross sectional view showing the construction of the pressing roll included in the conventional fixing device.
Figure 3:
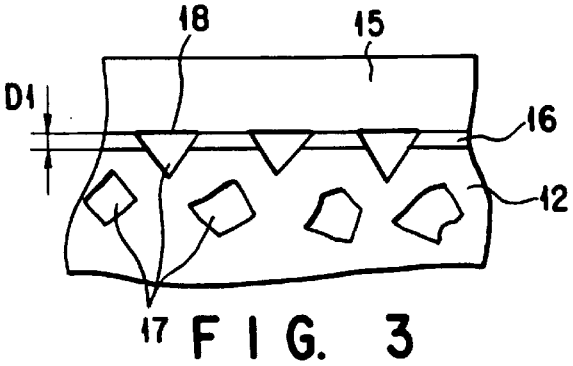
FIG. 3 PRIOR ART
FIG. 3 shows in a magnified fashion the pressing roll shown in FIG. 2 before deformation under pressure.
Figure 4:
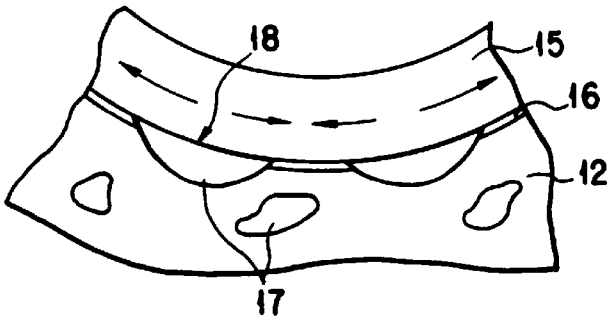
FIG. 4 PRIOR ART
FIG. 4 shows in a magnified fashion the pressing roll shown in FIG. 2 after deformation under pressure.

The pressing roll included in the fixing device of the present invention comprises a sponge layer. In general, the sponge layer is formed of, for example, chloroprene rubber, nitrile rubber, ethylene-propylene copolymer rubber, silicone rubber, fluorinated silicone rubber and fluororubber. Particularly, it is desirable to use a silicone rubber in view of its workability and uniformity of the sponge cells. Also, it is possible to add various additives to the material of the sponge layer including, for example, an electrical conductivity imparting agent such as carbon black, a highly dielectric material such as barium titanate, a heat conductivity imparting agent such as a metal power or a metal oxide powder, a heat resistance improving agent such as ferric oxide, an antistatic agent such as a surface active agent, and an adhesivity imparting agent such as a coupling material.

In the present invention, through-holes are formed in the sponge layer. In an aspect of the present invention, these through-holes should extend in a direction parallel with the axis of the core (i.e., should extend in an axial direction of the core). Also, these through-holes should be formed equidistantly from the outer circumferential surface of the core. In another aspect of the present invention, these through-holes should spirally extend along the length of the core. These spiral through-holes should desirably be arranged equidistantly from the outer circumferential surface of the core, though reasonable effects can be obtained even if the distance between the through-hole and the outer surface of the core is somewhat uneven. The number and diameter of the through-holes should be determined appropriately in view of the heat dissipating effect and hardness of the sponge layer.

The materials of the sponge layer described above can also be used for forming the rubbery elastic layer included in the pressing roll of the present invention. Particularly, it is desirable to use a silicone rubber for forming the rubbery elastic layer in view of, for example, the workability of the silicone rubber. If an adhesivity is imparted in advance to the silicone rubber, the manufacturing process of the pressing roll can be shortened. Further, as in the case of the sponge layer, various additives such as an electrical conductivity imparting agent and thermal conductivity imparting agent can be added to the material of the rubbery elastic layer.

The materials used for forming the fluorocarbon resin layer included in the pressing roll of the present invention include, for example, PFA (perfluoroalkyl vinyl ether) resin, PTFE (polytetrafluoroethylene) resin, FEP (tetrafluoroethylene-hexafluoropropylene copolymer) resin and a mixture thereof. The fluorocarbon resin layer may have an electrical conductivity, and may be of a single layer structure or a multi-layer structure. Further, the fluorocarbon resin layer may contain various additives such as a metal, an alloy, a ceramic material, a fiber, a highly dielectric material, or an abrasion resistant material. Incidentally, special attentions need not be paid to a friction coefficient on the surface of the fluorocarbon resin layer.

In the pressing roll included in the fixing device of the present invention, a rubbery elastic layer having a thickness of 350 to 4500 $\mu$m is interposed between a sponge layer having through-holes formed therein and a fluorocarbon resin layer. As a result, the pressing roll is enabled to exhibit a high durability.

EXAMPLES OF THE INVENTION

Figure 5:
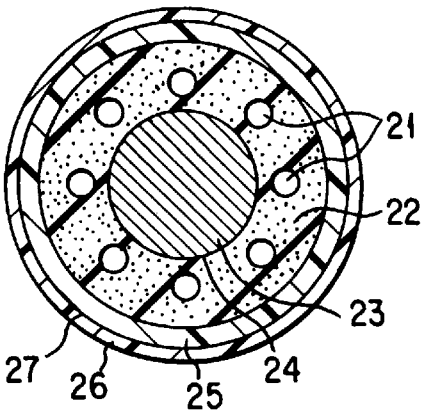
FIG. 5 is a cross sectional view showing the construction of the pressing roll included in a fixing device of the present invention.

Let us describe some examples of the present invention with reference to FIG. 5. Examples 1 to 5 and Comparative Examples 1 to 3:

FIG. 5 is a cross sectional view showing a pressing roll included in the fixing device of the present invention. The pressing roll shown in FIG. 5 is used together with a thermal fixing roll as shown in FIG. 1 so as to form a fixing device.

In Example 1, a sponge rubber layer 22 having a number of through-holes 21 was formed to cover the outer circumferential surface of a core 23, with an adhesive layer 24 interposed therebetween, as shown in FIG. 5. The sponge rubber layer 22 had an outer diameter of 29.3 mm. The through-holes 21 were formed to extend in a direction parallel with the axis of the core 23 and arranged equidistantly from the outer circumferential surface of the core 23. Further, a rubbery elastic layer 25 having a thickness of 350 $\mu$m was formed to cover the outer circumferential surface of the sponge rubber layer 22. The hardness of the rubbery elastic layer 25 w as set higher than that of the sponge rubber layer 22. This relationship in hardness was intended to s et the pressure in the nipping portion at a sufficiently high level in the toner fixing step. Also, the stress in the roll deformation step is considered to be concentrated on a lower hardness portion, leading to breakage of the roll. The particular relationship in hardness noted above was also intended to prevent this problem. Still further, a fluorocarbon resin layer 26 was formed to cover the outer circumferential surface of the rubbery elastic layer 25, with an adhesive layer 27 interposed therebetween. The pressing rolls in Examples 2 to 5 and Comparative Examples 1 to 3 differ from that of Example 1 simply in the thickness of the rubbery elastic layer 25, though the thickness of the rubbery elastic layer for each of Examples 2 to 5 was set to fall within a range of between 350 and 4500 $\mu$m specified in the present invention. On the other hand, the thickness of the rubbery elastic layer for each of Comparative Examples 1 to 3 failed to fall within the range specified in the present invention.

In the pressing roll for Example 1, the rubbery elastic layer 25 having a thickness of 350 $\mu$m was formed between the sponge rubber layer 22 having a number of through-holes formed therein to extend in an axial direction of the core and the fluorocarbon resin layer 26. A fixing device comprising the particular pressing roll and a thermal fixing roll as shown in FIG. 1 has been found to exhibit an excellent durability even under the conditions of a high rotating speed, a high load and a large nipping width. As a matter of fact, a durability test was applied to the fixing device having the particular pressing roll mounted therein in an attempt to examine the maximum number of copying paper sheets handled by the fixing device and the degree of the toner fixation. Table 1 shows the result. For measuring the degree of the toner fixation, an adhesive tape available on the market, i.e., a cello tape, was pushed with a force of 1 kgf/inch$^2$ against the toner fixed to a copying paper sheet, followed by peeling the adhesive tape from the copying paper sheet. The degree of the toner fixation was determined by the percentage of the toner remaining on the copying paper sheet after peeling of the adhesive tape. Table 1 also shows the results of the tests for each of Examples 2 to 5 and Comparative Examples 1 to 3.

TABLE 1

| | Thickness of Rubbery Elastic layer (μm) | Outer diameter of sponge rubber layer (mm) | Maximum number of copied paper sheets (× 1000) | Toner Fixation Degree |
|---|---|---|---|---|
| Comparative Example 1 | 100 | 29.8 | 150 | ○ |
| Comparative Example 2 | 200 | 29.6 | 165 | ○ |
| Example 1 | 350 | 29.3 | 300 | ○ |
| Example 2 | 750 | 28.5 | 330 | ○ |
| Example 3 | 1500 | 27.0 | 310 | ○ |
| Example 4 | 3000 | 24.0 | 450 | ○ |
| Example 5 | 4500 | 21.0 | 410 | ○ |
| Comparative Example 3 | 6000 | 18.0 | 390 | Δ |

The marks "○", "Δ" and "X" denoting the toner fixation degree in Table 1 are defined to denote the percentage rages given below:

○ . . . 100 to 85%;

Δ . . . 84 to 50%;

X . . . 49 to 0%

Figure 6:
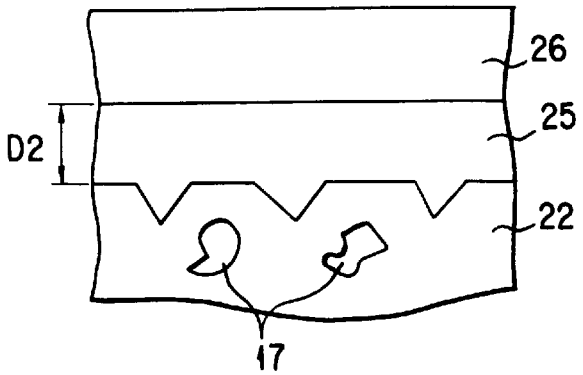
FIG. 6 shows in a magnified fashion the pressing roll shown in FIG. 5 before deformation under pressure.
Figure 7:
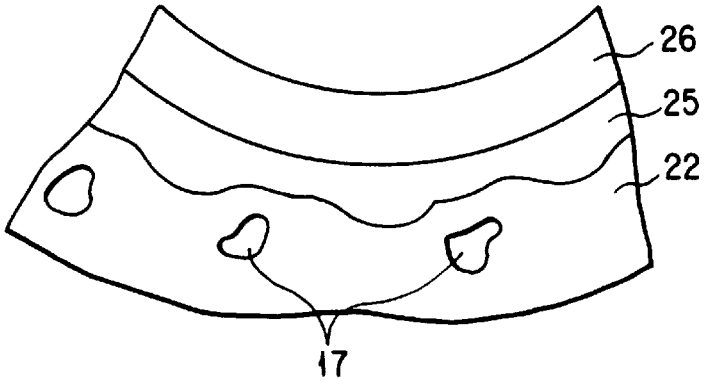
FIG. 7 shows in a magnified fashion the pressing roll shown in FIG. 5 after deformation under pressure.

Table 1 clearly shows that the pressing roll in each of Examples 2 to 5, in which the thickness of the rubbery elastic layer fell within the range of between 350 and 4500 μm specified in the present invention, was also satisfactory in each of the durability and the toner fixation degree.

Where load is not applied to the pressing roll for Example 1, the rubbery elastic layer 25 having a thickness $D_2$ was formed between the fluorocarbon resin layer 26 and the sponge rubber layer 22, as shown in FIG. 6. Even if the pressing roll is deformed upon receipt of load, the fluorocarbon resin layer 26 is unlikely to be peeled because non-contact portions as in the prior art are not formed as shown in FIG. 7.

<Preparation of Pressing Roll>

In preparing the pressing roll for Example 1, a compound of the composition given below was prepared first:

| | Parts by weight |
|---|---|
| SILASTIC Q4-2862 (Silicone Rubber Compound, manufactured by Dow Corning STI.) | 100 |
| 5-Min-U-SIL (Silica Powder manufactured by Pennsylvania Glass and Co.) | 5.0 |
| RED Iron Oxide (Iron Oxide (II)) | 1.0 |
| STI-T (2,4-Dichloro Benzyl Peroxide manufactured by Dow Corning STI.) | 1.5 |
| STI-V (2,5-Dimethyl-2,5-Di(tert-Butyl Peroxy) Hexane manufactured by Dow Corning STI.) | 3.5 |
| Ceiogen OT (p,p'-Oxybis (benzene sulphonyl hydrazide) manufactured by Uniroyal Inc.) | 5.0 |

used for preparing a sponge layer. The resultant silicone rubber compound was heated and foamed at 250° C. for 20 minutes by using an extruder and a heating furnace so as to obtain a sponge tube having an inner diameter of 9 mm, an outer diameter of 35 mm, and a number of through-holes formed therein. The resultant sponge tube was cut into a suitable length for fitting over a core 23 having an outer diameter of 10 mm, followed by mounting the cut piece of the sponge tube to the core 23 so as to obtain a sponge roll. Further, the sponge roll was subjected to grinding to reduce the outer diameter of the sponge roll to 29.3 mm, thereby preparing a sponge rubber layer 81. The resultant sponge rubber layer was found to have an Asker C sponge hardness of 40°.

Figure 8:
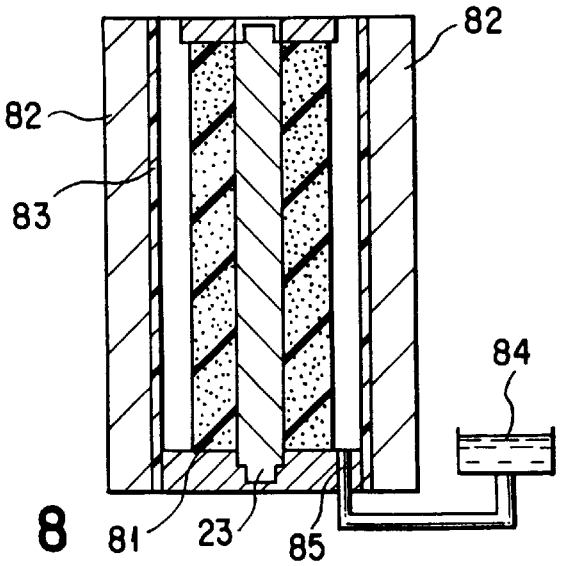
FIG. 8 is a cross sectional view schematically showing an apparatus used for molding a rubbery elastic layer included in the pressing roll used in the present invention.

In the next step, the inner surface of a PFA resin layer (fluorocarbon resin layer) formed of FURON resin manufactured by Bunnel Plastics Division, said PFA resin layer having an inner diameter of about 30 mm and a thickness of 50 μm, was coated with 1200 RT primer (an adhesive for a silicone rubber manufactured by Dow Corning) and, then, dried. The resultant structure was set within a stainless steel pipe 82 acting as a mold and having an inner diameter of 30 mm together with the sponge rubber layer 81, as shown in FIG. 8. As seen from FIG. 8, a clearance was formed between the sponge rubber layer 81 and the fluorocarbon resin tube 83.

A liquid silicone rubber 84 (trade name of SILATIC 9280-40 by Dow Corning STI.) having a Shore D hardness of 38° was prepared and defoamed, followed by injecting the liquid silicone rubber into the clearance noted above through an injection hole 85 formed at a bottom portion of the apparatus. After the injection, the stainless steel pipe 82 was closed and subjected to a thermal curing treatment at 150° C. for 30 minutes within a constant temperature bath. After cooling, a desired pressing roll was taken out of the mold of the stainless steel pipe.

In Example 1, the outer diameter of the sponge rubber layer was set at 29.3 mm and the outer diameter of the pressing roll was set at 30.0 mm. On the other hand, the outer diameter of the sponge rubber layer was set as shown in Table 1 in each of Examples 2 to 5. The pressing rolls of Examples 2 to 5 were found to be satisfactory in each of the durability and the toner fixation degree like the pressing roll of Example 1, as shown in Table 1. On the other hand, the pressing rolls of Comparative Examples 1 and 2 were not satisfactory in the durability. Also, the pressing roll of Comparative Example 3 was not satisfactory in the toner fixation degree.

<Durability Test of Pressing Rolls having Rubbery Elastic Layers of Different Hardness>

A durability test was applied to pressing rolls comprising rubbery elastic layers made of different materials and, thus, having different hardness. The pressing rolls were manufactured as in Example 1, with the results as shown in Table 2 below. Incidentally, the hardness of the sponge rubber layer included in each of these pressing rolls was set at Asker C 40°:

TABLE 2

| Rubbery Elastic Layer | | | Maximum number of copied paper sheets | Toner Fixation Degree |
|---|---|---|---|---|
| | Hardness | | | |
| Material | Shore A | Asker C | (× 1000) | |
| KE-1950-10*1 | 12 | 37 | 320 | Δ |
| KE-1340*1 | 18 | 43 | 360 | ○ |
| SILASTIC*2 9280-30 | 30 | 55 | 410 | ○ |
| SILASTIC*2 9280-40 | 38 | 63 | 390 | ○ |
| Elastosil*3 LS-3162 | 50 | 75 | 400 | ○ |
| TC-3 280G*4 | 60 | 82 | 420 | ○ |

Notes:
*1(KE-1950-10; KE-1340): SHINCOR Silicone
*2(SILASTIC 9280-30; SILASTIC 9280-40): Dow Corning STI.
*3(Elastosil LS-3162): Wacker Silicone Corporation
*4(TC-3 280G): GE Silicone As apparent from Table 2, the hardness of the rubbery elastic layer was Asker 37°, which was lower than Asker C 40° of the sponge rubber layer hardness, in the case of using KE-1950-10 for forming the rubbery elastic layer, with the result that the toner fixation degree was insufficient. However, where the hardness of the rubbery elastic layer was higher than Asker 40°, the pressing rolls were found to be satisfactory in each of the maximum number of copied paper sheets and the toner fixation degree. The experimental data clearly support that it is necessary for the rubbery elastic layer to have a hardness higher than that of the sponge rubber layer in terms of the durability and the toner fixation degree.

<Durability Test of Pressing Rolls having Fluorocarbon Resin Layers of Different Thickness>

A durability test was applied to pressing rolls comprising fluorocarbon resin layers having different thicknesses in an attempt to measure the maximum number of copied paper sheets, the toner fixation degree, and wrinkle occurrence on the copied paper sheet. The pressing rolls used in this experiment were prepared as in Example 1, except that the thickness of the rubbery elastic layer was set at 1,000 μm. Table 3 shows the results of this durability test:

TABLE 3

| Roll NO. | Thickness of Fluorocarbon Resin layer (μm) | Maximum number of copied paper sheets (× 1000) | Nip width (mm) | Toner Fixation Degree | * |
|---|---|---|---|---|---|
| 1 | 20 | 300 | 18 | ○ | X |
| 2 | 30 | 350 | 15 | ○ | ○ |
| 3 | 110 | 360 | 10 | ○ | ○ |
| 4 | 500 | 420 | 7 | ○ | ○ |
| 5 | 750 | 480 | 5 | Δ | ○ |

*Degree of wrinkle generation on the copied paper sheet.

The degree of wrinkle generation on the copied paper sheet shown in Table 3 is based on 1000 copied paper sheets, which is evaluated in Table 3 as follows:

○ . . . not more than 0.3%;

Δ . . . not more than 0.7%;

X . . . not less than 0.8%.

Table 3 clearly shows that the fluorocarbon resin layer is required to have a thickness falling within a range of between 30 μm and 500 μm.

Comparative Examples 4 and 5:

As in Example 1, a silicone sponge rubber layer was formed to cover the outer circumferential surface of a core, followed by subjecting the sponge rubber layer to grinding to reduce the outer diameter of the sponge rubber layer from 29.85 to 30.15 mm. Then, a plastic adhesive layer (trade name of SEALANT 739 manufactured by Dow Corning and having a Shore A hardness of 28°) was formed in a thickness of 50 to 70 μm to cover the outer circumferential surface of the sponge rubber layer. Further, a fluorocarbon resin tube having an inner diameter of 29.5 mm was fit over the adhesive layer, thereby obtaining a pressing roll for Comparative Example 4 having a final outer diameter of 30.0 mm. A pressing roll for Comparative Example 5 was similarly prepared, except that the inner surface of the fluorocarbon resin tube was also coated with 1200 RTV PRIME COAT, which is a trade name of a plastic adhesive manufactured by Dow Corning. These pressing rolls for Comparative Examples 4 and 5 were subjected to a durability test, with the results as shown in Table 4 below:

TABLE 4

| | A* | B* | C* |
|---|---|---|---|
| Comparative Example 4 | — | 50 to 70 | 185 |
| Comparative Example 5 | 5 to 7 | 50 to 70 | 223 |

Notes (*):
A . . . Thickness (μm) of primer coating on the inner surface of the fluorocarbon resin tube;
B . . . Thickness (μm) of cement coating on the outer surface of the sponge rubber layer;
C . . . Maximum number of copied paper sheets (multiplied by 1,000).

Table 4 clearly shows that each of the pressing rolls for Comparative Examples 4 and 5 fails to exhibit a sufficiently high durability.

In each of the Examples described above, 8 through-holes were formed in the sponge rubber layer such that these through-holes extend in parallel with the axis of the core and are positioned substantially equidistantly from the outer circumferential surface of the core. However, the number and arrangements of these through-holes need not be limited to those in the Examples described herein. For example, it is possible for the sponge rubber layer to be provided with an optional number, such as 7 or 9, of through-holes. Also, it is acceptable for these through-holes to be positioned somewhat uneven in the distance from the outer circumferential surface of the core. Further, it is possible for these through-holes to extend spirally along the core.

What is claimed is:

1. A fixing device comprising a thermal fixing roll and a pressing roll forming a nip portion together with the thermal fixing roll, characterized in that the pressing roll comprises a core, a sponge rubber layer covering the outer circumferential surface of the core and provided with a large number of through-holes extending in parallel with the axis of the core, a rubbery elastic layer formed in a thickness of 350 to 4500 μm to cover the outer circumferential surface of the sponge layer, and a fluorocarbon resin layer formed to cover the outer circumferential surface of the rubbery elastic layer.

2. The fixing device according to claim 1, wherein the hardness of the rubbery elastic layer included in said pressing roll is higher than that of the sponge rubber layer included in the pressing roll.

3. The fixing device according to claim 1, wherein said fluorocarbon resin layer included in the pressing roll has a thickness falling within a range of between 30 and 500 μm.

4. A fixing device comprising a thermal fixing roll and a pressing roll forming a nip portion together with the thermal fixing roll, characterized in that the pressing roll comprises a core, a sponge layer covering the outer circumferential surface of the core and provided with a large number of spiral through-holes spirally extending along the core, a rubbery elastic layer formed in a thickness of 350 to 4500 $\mu$m to cover the outer circumferential surface of the sponge layer, and a fluorocarbon resin layer formed to cover the outer circumferential surface of the rubbery elastic layer.

5. The fixing device according to claim 4, wherein the hardness of the rubbery elastic layer included in said pressing roll is higher than that of the sponge rubber layer included in the pressing roll.

6. The fixing device according to claim 4, wherein said fluorocarbon resin layer included in the pressing roll has a thickness falling within a range of between 30 and 500 $\mu$m.

* * * * *